United States Patent [19]

Gurevitz

[11] 4,206,869

[45] Jun. 10, 1980

[54] SHELF STORAGE BOX

[76] Inventor: Michael J. Gurevitz, 9049 N. Bronx, Skokie, Ill. 60076

[21] Appl. No.: 31,080

[22] Filed: Apr. 18, 1979

[51] Int. Cl.[2] ..... B65D 5/22

[52] U.S. Cl. ..... 229/34 R; 40/312; 312/234.1

[58] Field of Search ..... 229/34 R; 312/183, 234.1; 229/31 FS; 40/312

[56] References Cited

U.S. PATENT DOCUMENTS

| | | | |
|---|---|---|---|
| 2,135,021 | 11/1938 | Zalkind | 229/34 R X |
| 2,136,184 | 11/1938 | Fellowes | 229/34 R |
| 2,136,797 | 11/1938 | Lee | 229/34 R |
| 2,395,363 | 2/1946 | Williams | 229/34 R |
| 2,644,632 | 7/1953 | Claff | 229/34 R |
| 2,938,623 | 5/1960 | Eichorn | 229/34 R X |
| 2,960,149 | 11/1960 | Throssel | 229/34 R X |
| 3,465,945 | 9/1969 | Reemberg | 229/34 R |
| 3,658,234 | 4/1972 | Deckys | 229/31 FS |
| 3,784,083 | 1/1974 | Pfaffendorf | 229/34 R |
| 4,004,691 | 1/1977 | Wihksne | 40/312 X |

*Primary Examiner*—Davis T. Moorhead

*Attorney, Agent, or Firm*—Thomas R. Vigil

[57] ABSTRACT

The shelf storage box is of the type which has a bottom panel, side panels, a back wall formation and a front wall formation which is not as high as the side panels and back wall formation so that one can see the contents of the box. The front wall formation includes two flaps that extend respectively from the side panels in overlapping relationship and a foldable panel hinged to the bottom wall panel and extending upwardly and over the flaps. A first panel section of the foldable panel has a cut therein which extends from the bottom panel upwardly, across a portion of the panel section, and then downwardly to the bottom panel to form a foldout handle formation with the space left by the foldout handle formation defining a window. The foldout handle formation has a hole therein to facilitate gripping of the handle with a finger. Further, the box includes a card which is sized to fit within the front wall formation between the first panel section and the flaps and has a portion thereof which is exposed in the window and which is adapted to have indicia marked thereon to indicate the contents of the box.

4 Claims, 4 Drawing Figures

FIG. 1
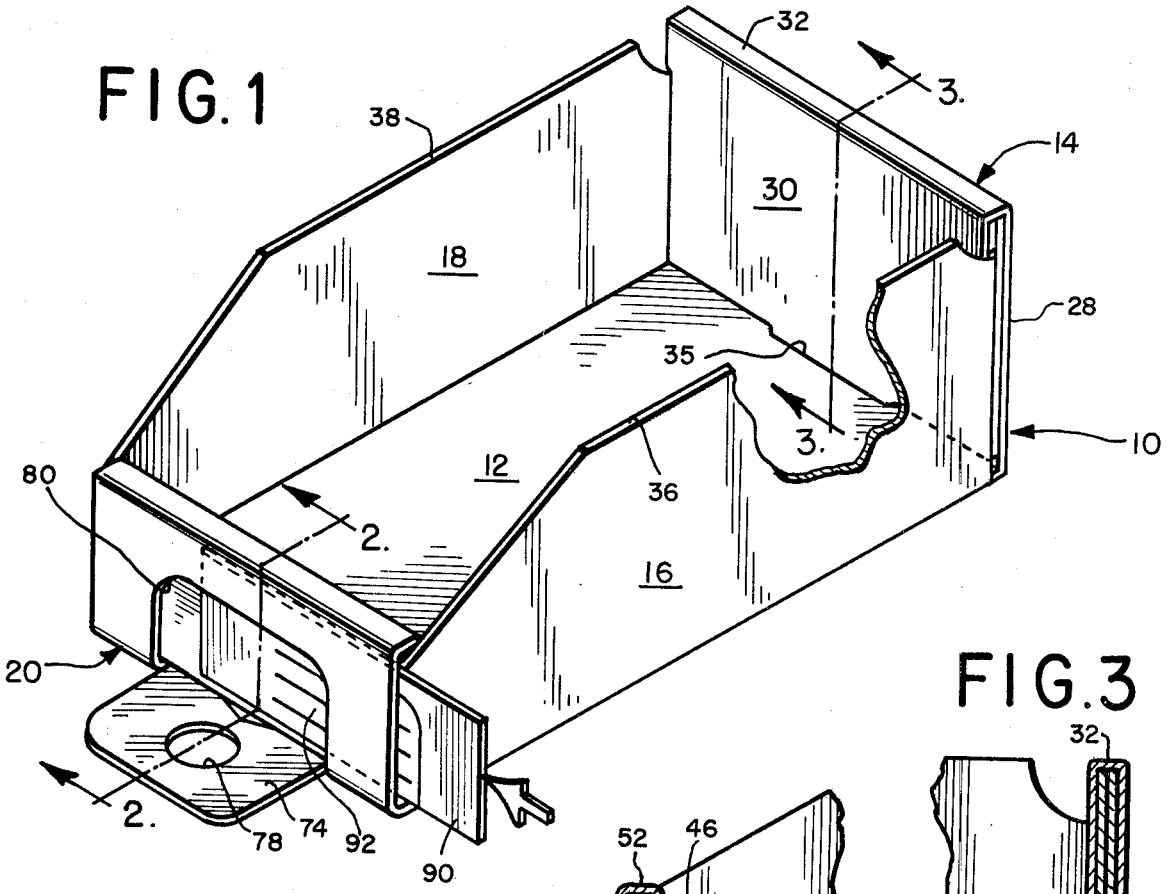
FIG. 3
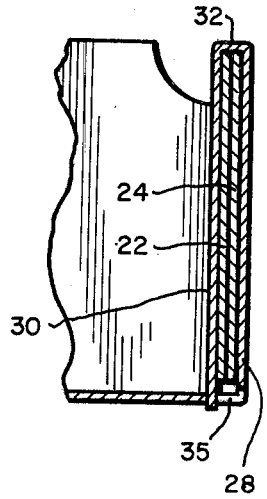
FIG. 2
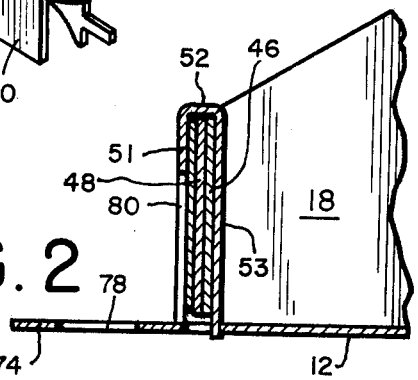
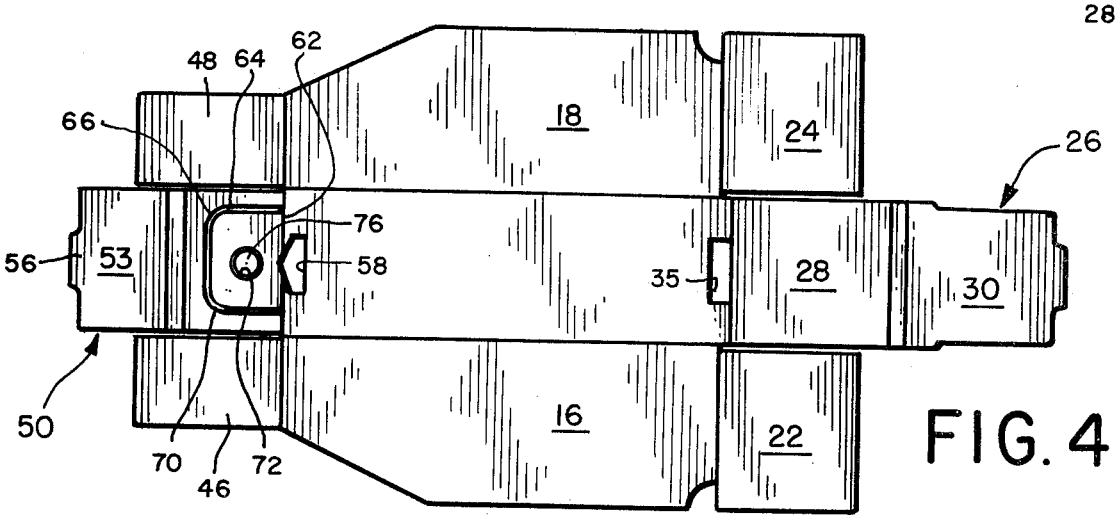
FIG. 4

SHELF STORAGE BOX

BACKGROUND OF THE INVENTION

1. Field of the Invention.

The present invention relates to a shelf storage box with a combination information card holding formation and handle formation.

2. Description of the Prior Art.

Heretofore various shelf storage box arrangements with punch out handles, windows for reception of information cards and other configurations have been proposed. Examples of such prior art shelf storage boxes are disclosed in the following patents.

| U.S. PAT. NO. | PATENTEE |
|---|---|
| 654,545 | Johnson |
| 2,135,021 | Zalkind |
| 2,644,632 | Calff |
| 2,938,623 | Eichorn |
| 3,465,945 | Reenberg |
| 3,658,234 | Deckys |
| 3,784,083 | Pfaffendors et al. |

The Zalkind U.S. Pat. No. 2,135,021 discloses a drawer type box which has a punch out tab forming a handle for the box.

The Calff U.S. Pat. No. 2,644,632 discloses a shelf storage box having a window for an identification card.

The Eichorn U.S. Pat. No. 2,938,623 discloses a box having a pullout handle with a separate removable tab which will provide a window for receiving an identification card.

As will be described in greater detail hereinafter, the shelf storage box of the present invention differs from the previously proposed shelf storage boxes by providing a handle formation which is arranged so that when it is folded out from the front wall formation of the box, the space provided is utilized as a window for exposing information regarding the contents of the box on an information card which is received within the front wall formation. Further, the handle formation has a hole therein to facilitate gripping of the handle formation by a finger.

SUMMARY OF THE INVENTION

According to the invention there is provided a shelf storage box comprising a bottom panel, a back wall formation, first and second side panels, and a front wall formation which form said box with an open top, said front wall formation including a first flap hinged to said first side panel and extending 90° therefrom, a second flap hinged to said second side panel and extending 90° therefrom over said first flap, a foldable panel hinged to said bottom panel and having a first panel section extending upwardly from said bottom panel adjacent said second flap, a short width second panel section hinged to said first panel section and extending over said flaps and a third panel section extending downwardly from said second panel section adjacent said first flap, at least one tab extending from the free edge of said third panel section, said bottom panel having a slot for receiving said tab, said first panel section having a cut extending upwardly from said bottom panel across a portion of said first panel section and then downwardly to said bottom panel to provide, when folded downwardly, a handle formation whereby the box can be easily pulled outwardly on a shelf, a closed loop cut in said handle formation to form a punch out hole therein for receiving a finger and said space formed in said first panel portion in front of said second flap when said handle formation is folded downwardly forming a window, and said box further including a card which is sized to fit within said front wall formation between said second flap and said first panel section and having a portion thereof adapted to be positioned in said window and to have indicia marked thereon indicating the contents of the box.

Further according to the invention there is provided a blank for forming a shelf storage box including a bottom panel, opposed side panels hingedly connected to said bottom panel and foldable upwardly, a flap hingedly connected to each corner forming edge of each of said side panels, a first foldable panel hingedly connected to one side of said bottom panel for forming with a first pair of said flaps a back wall formation and a second foldable panel hingedly connected at a score line to the opposite side of said bottom panel and including a first panel section which is foldable upwardly next to a second pair of said flaps when they are folded inwardly from said side panels, a short width second panel section hingedly connected to said first panel section and foldable over said second pair of flaps and a third panel section hingedly connected to said second panel section and having a tab on the free edge thereof, a slot in said bottom panel adjacent said score line between said bottom panel and said second foldable panel and adapted to receive said tab at the end of said third panel section, a cut in said first panel section extending from said score line to a rounded corner, across said panel section generally parallel to said score line to a second rounded corner and then to said score line to form a handle formation which is foldable out of said first panel section and a closed loop cut in said handle formation for punching out a finger receiving hole in said handle formation.

BRIEF DESCRIPTION OF THE DRAWINGS

FIG. 1 is a perspective view with portions broken away of the shelf storage box of the present invention.

FIG. 2 is a fragmentary vertical sectional view taken along line 2—2 of FIG. 1.

FIG. 3 is a fragmentary vertical sectional view taken along line 3—3 of FIG. 1.

FIG. 4 is a plan view of the blank from which the shelf storage box shown in FIG. 1 is formed.

DESCRIPTION OF THE PREFERRED EMBODIMENT

Referring now to the drawings in greater detail there is illustrated in FIG. 1 a shelf storage box 10 which includes a bottom panel 12, a back wall formation 14, opposed first and second side panels 16 and 18 and a front wall formation 20. As shown in FIGS. 1, 3 and 4, the back wall formation is formed by two flaps 22 and 24 which are hinged respectively to the side walls 16 and 18. Further the back wall formation 14 includes a foldable panel 26 hinged to the bottom panel 12 and including first and second panel sections 28 and 30 which overlap the flaps 22 and 24. A short width panel section 32 is hingedly connected to and between the first and second panel sections 28 and 30. A tab 34 is provided at the outer end of the second panel section 30 and is received in a slot 35 in the bottom panel 12.

As shown, upper edges 36 and 38 of each of the side panels 16 and 18 extend from the back wall formation 14 forwardly toward the front wall formation 20 and then at a predetermined location the edges 36 and 38 slope downwardly to the front wall formation 20 which has a lower height than the back wall formation 14. The space above and just behind the front wall formation 20 enables one to look into the box 10 to see the contents thereof.

According to the teachings of the present invention, the front wall formation 20 includes a first flap 46 hingedly connected to the first side panel 16 and extending inwardly 90° from the first side panel 16 and a second flap 48 that extends from the second side panel 18 and is folded inwardly over the first flap 46 as shown in FIG. 2. The front wall formation 20 further includes a foldable panel 50 which is hingedly connected to the bottom panel 12 and which is adapted to be folded upwardly and about the first and second flaps 46 and 48. The foldable panel 50 includes a first panel section 51 hingedly connected to the bottom panel 12, a short width second panel section 52 hingedly connected to the first panel section 51 and adapted to extend over the top edges of the first and second flaps 46 and 48 and a third panel section 53 hingedly connected to the second panel section 52 and adapted to extend generally vertically downwardly to the bottom panel 12. A tab 56 is provided at the free edge of the third panel section 53 and is received in a slot 58 formed in the bottom wall panel 12 for holding the front wall formation in place.

The box 10 is formed from a blank of double faced corrugated paperboard which includes the various panels, flaps and panel sections defined above separated by score lines which define the various hinged connections between the panels and flaps. Boxes 10 of different lengths and widths can be provided and a blank 60 for a smaller width box 10 is shown in FIG. 4.

As shown, the second foldable panel 50 in the blank 60 is separated from the bottom panel 12 by a score line 62. A cut 64 extends from the score line 62 into the first panel section 51 to a rounded corner 66 thereof, across the first panel section 51 generally parallel to the score line to a second rounded corner 70 thereof and then back to the score line 62. Also, a closed loop cut 72 is provided centrally within the first panel section 51 within a handle formation 74 defined by the portion of the blank 60 enclosed by the cut 64 and the score line 62. The cut 72 forms a circular punch out 76 which, when punched out forms a finger receiving hole 78 (FIG. 1) for facilitating gripping of the handle formation 74.

Also, as best shown in FIG. 1, the space provided in the first panel section 51 when the handle formation 74 is folded downwardly defines a window 80 in which can be exposed information relating to the contents of the box. In this respect and according to the teachings of the present invention the shelf storage box 10 includes a card 90 which is sized and adapted to be received within the front wall formation 20 between the first panel section 51 and the second flap 48. This card 90 has space 92 on one side thereof which is exposed in the window 80 and on which information identifying the contents of the box 10 can be marked. In this way the cut 64 not only defines the foldout handle formation 74 but also defined a window 80 for exposing information on the card 90 inserted between the second flap 48 and the first panel section 51.

From the foregoing description it will be apparent that the shelf storage box 10 and the blank 60 from which it is formed provide a number of advantages, some of which have been described above, and others of which are inherent in the invention. Specifically, it provide the foldout handle formation 74 which, when folded out, leaves a space forming the window 80 for exposing identifying information on the identification card 90 which is inserted between the first panel section 51 and the second flap 48.

Further from the foregoing description it will be apparent that obvious modifications and variations can be made to the shelf storage box 10 and the blank 60 therefor without departing from the teachings of the invention. Accordingly, the scope of the present invention is only to limited as necessitated by the accompanying claims.

I claim:

1. A shelf storage box comprising a bottom panel, a back wall formation, first and second side panels, and a front wall formation which form said box with an open top, said front wall formation including a first flap hinged to said first side panel and extending 90° therefrom, a second flap hinged to said second side panel and extending 90° therefrom over said first flap, a foldable panel hinged to said bottom panel and having a first panel section extending upwardly from said bottom panel adjacent said second flap, a short width second panel section hinged to said first panel section and extending over said flaps and a third panel section extending downwardly from said second panel section adjacent said first flap, at least one tab extending from the free edge of said third panel section, said bottom panel having a slot for receiving said tab, said first panel section having a cut extending upwardly from said bottom panel across a portion of said first panel section and then downwardly to said bottom panel to provide, when folded downwardly, a handle formation whereby the box can be easily pulled outwardly on a shelf, a closed loop cut in said handle formation to form a punch out hole therein for receiving a finger and said space formed in said first panel portion in front of said second flap when said handle formation is folded downwardly forming a window, and said box further including a card which is sized to fit within said front wall formation between said second flap and said first panel section and having a portion thereof adapted to be positioned in said window and to have indicia marked thereon indicating the contents of said box.

2. The shelf storage box according to claim 1 being made of double faced corrugated paperboard.

3. The shelf storage box according to claim 1 wherein each of said side panels has an upper edge which extends forwardly from said back wall formation and then downwardly toward said front wall formation, and which has a height less than the height of said back wall formation.

4. A blank for forming a shelf storage box including a bottom panel, opposed side panels hingedly connected to said bottom panel and foldable upwardly, a flap hingedly connected to each corner forming edge of each of said side panels, a first foldable panel hingedly connected to one side of said bottom panel for forming with a first pair of said flaps a back wall formation and a second foldable panel hingedly connected at a score line to the opposite side of said bottom panel and including a first panel section which is foldable upwardly next to a second pair of said flaps when they are folded inwardly from said side panels, a short width second panel section hingedly connected to said first panel section and foldable over said second pair of flaps and a third panel section hingedly connected to said second panel section and having a tab on the free edge thereof, a slot in said bottom panel adjacent said score line between said bottom panel and said second foldable panel and adapted to receive said tab at the end of said third panel section, a cut in said first panel section extending from said score line to a rounded corner, across said panel section generally parallel to said score line to a second rounded corner and then to said score line to form a handle formation which is foldable out of said first panel section and a closed loop cut in said handle formation for punching out a finger receiving hole in said handle formation.

* * * * *